US009460732B2

(12) United States Patent
Wingate et al.

(10) Patent No.: US 9,460,732 B2
(45) Date of Patent: Oct. 4, 2016

(54) SIGNAL SOURCE SEPARATION

(71) Applicant: Analog Devices, Inc., Norwood, MA (US)

(72) Inventors: David Wingate, Framingham, MA (US); Noah Stein, Somerville, MA (US)

(73) Assignee: Analog Devices, Inc., Norwood, MA (US)

( * ) Notice: Subject to any disclaimer, the term of this patent is extended or adjusted under 35 U.S.C. 154(b) by 151 days.

(21) Appl. No.: 14/138,587

(22) Filed: Dec. 23, 2013

(65) Prior Publication Data

US 2014/0226838 A1 Aug. 14, 2014

Related U.S. Application Data

(60) Provisional application No. 61/764,290, filed on Feb. 13, 2013, provisional application No. 61/788,521, filed on Mar. 15, 2013, provisional application No. 61/881,678, filed on Sep. 24, 2013, provisional application No. 61/881,709, filed on Sep. 24, 2013, provisional application No. 61/919,851, filed on Dec. 23, 2013.

(51) Int. Cl.
*G10L 21/0272* (2013.01)
*H04R 1/40* (2006.01)

(52) U.S. Cl.
CPC ..... *G10L 21/0272* (2013.01); *H04R 1/406* (2013.01); *H04R 2201/003* (2013.01); *H04R 2430/21* (2013.01)

(58) Field of Classification Search
None
See application file for complete search history.

(56) References Cited

U.S. PATENT DOCUMENTS 5,627,899 A 5/1997 Craven et al.
6,688,169 B2 * 2/2004 Choe ..... H04R 23/00 73/170.13
6,889,189 B2 5/2005 Boman
(Continued)

FOREIGN PATENT DOCUMENTS

EP 2007167 12/2008
EP 2237272 10/2010
(Continued)

OTHER PUBLICATIONS

Zhang et al. "Two microphone based direction of arrival estimation for multiple speech sources using spectral properties of speech" *IEEE International Conference on Acoustics, Speech and Signal Processing*, pp. 2193-2196, Date of Conference: Apr. 19-24, 2009.
(Continued)

*Primary Examiner* — Paul Huber
(74) *Attorney, Agent, or Firm* — Patent Capital Group

(57) ABSTRACT

In one aspect, a microphone with closely spaced elements is used to acquire multiple signals from which a signal from a desired source is separated. The signal separation approach uses a combination of direction-of-arrival information or other information determined from variation such as phase, delay, and amplitude among the acquired signals, as well as structural information for the signal from the source of interest and/or for the interfering signals. Through this combination of information, the elements may be spaced more closely than may be effective for conventional beam-forming approaches. In some examples, all the microphone elements are integrated into a single a micro-electrical-mechanical system (MEMS).

38 Claims, 5 Drawing Sheets

(56) References Cited

U.S. PATENT DOCUMENTS

| | | | | |
|---|---|---|---|---|
| 7,092,539 | B2 * | 8/2006 | Sheplak | G01H 11/08 257/528 |
| 7,809,146 | B2 | 10/2010 | Hiroe | |
| 8,139,788 | B2 | 3/2012 | Hiroe | |
| 8,477,983 | B2 | 7/2013 | Weigold et al. | |
| 8,488,806 | B2 * | 7/2013 | Saruwatari | G10L 21/028 381/73.1 |
| 8,577,054 | B2 * | 11/2013 | Hiroe | G10L 21/0272 367/119 |
| 2004/0240595 | A1 | 12/2004 | Raphaeli | |
| 2005/0222840 | A1 | 10/2005 | Smaragdis | |
| 2008/0031315 | A1 | 2/2008 | Ramirez et al. | |
| 2008/0232607 | A1 * | 9/2008 | Tashev | G01S 3/86 381/71.11 |
| 2008/0288219 | A1 * | 11/2008 | Tashev | H04B 7/0854 702/190 |
| 2008/0298597 | A1 | 12/2008 | Turku | |
| 2008/0318640 | A1 * | 12/2008 | Takano | H04R 1/38 455/569.1 |
| 2009/0055170 | A1 | 2/2009 | Nagahama | |
| 2009/0214052 | A1 | 8/2009 | Liu et al. | |
| 2010/0138010 | A1 | 6/2010 | Aziz Sbai | |
| 2010/0164025 | A1 | 7/2010 | Yang | |
| 2010/0171153 | A1 | 7/2010 | Yang | |
| 2011/0015924 | A1 | 1/2011 | Gunel Hacihabiboglu et al. | |
| 2011/0054848 | A1 | 3/2011 | Kim | |
| 2011/0058685 | A1 | 3/2011 | Sagayama | |
| 2011/0081024 | A1 | 4/2011 | Soulodre | |
| 2011/0164760 | A1 * | 7/2011 | Horibe | G01S 3/8006 381/92 |
| 2011/0182437 | A1 | 7/2011 | Kim | |
| 2011/0307251 | A1 * | 12/2011 | Tashev | G10L 21/028 704/231 |
| 2011/0311078 | A1 * | 12/2011 | Currano | H04R 1/406 381/150 |
| 2012/0027219 | A1 | 2/2012 | Kale et al. | |
| 2012/0263315 | A1 | 10/2012 | Hiroe | |
| 2012/0300969 | A1 * | 11/2012 | Tanaka | H04R 19/005 381/355 |
| 2012/0328142 | A1 | 12/2012 | Horibe et al. | |
| 2013/0272538 | A1 | 10/2013 | Kim et al. | |
| 2014/0033904 | A1 * | 2/2014 | Swanson | G10H 3/24 84/723 |
| 2014/0133674 | A1 | 5/2014 | Mitsufuji | |
| 2014/0226838 | A1 | 8/2014 | Wingate | |
| 2014/0328487 | A1 | 11/2014 | Hiroe | |

FOREIGN PATENT DOCUMENTS

| | | |
|---|---|---|
| WO | 2005/122717 | 12/2005 |
| WO | 2015/048070 | 4/2015 |
| WO | 2015/157013 | 10/2015 |

OTHER PUBLICATIONS

Hu, Rongrong "Directional Speech Acquisition Using a MEMS Cubic Accoustical Sensor Microarray Cluster," retrived from the internet: http://search.prorequest.com/docview/305300918 [retrieved Jul. 2, 2014].

Marcos Turqueti et al., "MEMS Accoustic Array Embedded in an FPGA based data acquisition and signal processing system," Circuits and Systems (MWSCAS), 53rd IEEE International Midwest Symposium, Aug. 1, 2010, pp. 1161-1164.

International Search Report and Written Opinion, International Application No. PCT/US2014/016159, mailed Jul. 17, 2014 (10 pages).

Partial International Search for PCT/US2014/057122 mailed Mar. 5, 2015, 16 pages.

International Search Report in PCT Application U.S. Appl. No. PCT/US2015/071970 mailed Apr. 23, 2015, 8 pages.

International Search Report and Written Opinion issued in International Patent Application Ser. PCT/US2015/022822 mailed Jul. 23, 2015, 10 pages.

Fitzgerald, Derry et al., "Non-Negative Tensor Factorisation for Sound Source Separation", ISSC 2005, Dublin, Sep. 1-2.

Aoki, M. et al., "Sound Source Segregation Based on Estimating Incident Angle of Each Frequency Component of Input Signals Acquired by Multiple Microphones", Acoustical Science and Technology, Acoustical Society of Japan, Tokyo, JP, vol. 22, No. 2, Mar. 1, 2001, pp. 149-157.

Shujau, M. et al., "Separation of Speech Sources Using an Acoustic Vector Sensor", Multimedia Signal Processing (MMSP), 2001, IEEE 13th International Workshop, IEEE, Oct. 17, 2011, pp. 106.

Shoko, Araki et al., "Blind Sparse Source Separation for Unknown Number of Sources Using Gaussian Mixture Model Fitting with Dirichlet Prior", Acoustics, Speech and Signal Processing, 2009, Icassp 2009, IEEE International Conference, IEEE, Apr. 19, 2009, pp. 33-36.

S. Hiroshi. et al., "A Robust and Precise Method for Solving the Permutation Problem of Frequency-Domain Blind Source Separation", IEEE Transactions on Speech and Audio Processing, IEEE Service Center, New York, vol. 12, No. 5, Sep. 1, 2004, pp. 530-538.

Antoine Liutkus et al., "An Overview of Informed Audio Source Separation", HAL archives-ouvertes, https://hal.archives-ouvertes.fr/hal-00958661, Submitted Mar. 13, 2014, 5 pages.

Hiroshi G. Okuno et al., "Incorporating Visual Information into Sound Source Separation", Kitano Symbiotic System Project, ERATO, Japan Science and Technology Corp. 1996, 9 pages.

Erik Visser et al., "A Spatio-Temporal Speech Enhancement Scheme for Robust Speech Recognition in Noisy Environments", ELSEVIER, Available at www.computerscienceweb.com, Speech Communication, Received Apr. 1, 2002, Accepted Dec. 5, 2002, 15 pages.

OA1 mailed in U.S. Appl. No. 14/494,838 mailed Mar. 18, 2016, 26 pages.

* cited by examiner

SIGNAL SOURCE SEPARATION

CROSS-REFERENCE TO RELATED APPLICATIONS

This application claims the benefit of the following applications:

- U.S. Provisional Application No. 61/764,290, titled "SIGNAL SOURCE SEPARATION," filed on Feb. 13, 2013;
- U.S. Provisional Application No. 61/788,521, titled "SIGNAL SOURCE SEPARATION," filed on Mar. 15, 2013;
- U.S. Provisional Application No. 61/881,678, titled "TIME-FREQUENCY DIRECTIONAL FACTORIZATION FOR SOURCE SEPARATION," filed on Sep. 24, 2013;
- U.S. Provisional Application No. 61/881,709, titled "SOURCE SEPARATION USING DIRECTION OF ARRIVAL HISTOGRAMS," filed on Sep. 24, 2013; and
- U.S. Provisional Application No. 61/919,851, titled "SMOOTHING TIME-FREQUENCY SOURCE SEPARATION MASKS," filed on Dec. 23, 2013.

each of which is incorporated herein by reference.

This application is also related to, but does not claim the benefit of the filing date of, International Application No. PCT/US2013/060044, titled "SOURCE SEPARATION USING A CIRCULAR MODEL," filed on Sep. 17, 2013, which is also incorporated herein by reference.

BACKGROUND

This invention relates to separating source signals, and in particular relates to separating multiple audio sources in a multiple-microphone system.

Multiple sound sources may be present in an environment in which audio signals are received by multiple microphones. Localizing, separating, and/or tracking the sources can be useful in a number of applications. For example, in a multiple-microphone hearing aid, one of multiple sources may be selected as the desired source whose signal is provided to the user of the hearing aid. The better the desired source is isolated in the microphone signals, the better the user's perception of the desired signal, hopefully providing higher intelligibility, lower fatigue, etc.

One broad approach to separating a signal from a source of interest using multiple microphone signals is beamforming, which uses multiple microphones separated by distances on the order of a wavelength or more to provide directional sensitivity to the microphone system. However, beamforming approaches may be limited, for example, by inadequate separation of the microphones.

Interaural (including inter-microphone) phase differences (IPD) have been used for source separation from a collection of acquired signals. It has been shown that blind source separation is possible using just IPD's and interaural level differences (ILD) with the Degenerate Unmixing Estimation Technique (DUET). DUET relies on the condition that the sources to be separated exhibit W-disjoint orthogonality. Such orthogonality means that the energy in each time-frequency bin of the mixture's Short-Time Fourier Transform (STFT) is assumed to be dominated by a single source. The mixture STFT can be partitioned into disjoint sets such that only the bins assigned to the $j^{th}$ source are used to reconstruct it. In theory, as long as the sources are W-disjoint orthogonal, perfect separation can be achieved. Good separation can be achieved in practice even though speech signals are only approximately orthogonal.

Source separation from a single acquired signal (i.e., from a single microphone), for instance an audio signal, has been addressed using the structure of a desired signal by decomposing a time versus frequency representation of the signal. One such approach uses a non-negative matrix factorization of the non-negative entries of a time versus frequency matrix representation (e.g., an energy distribution) of the signal. One product of such an analysis can be a time versus frequency mask (e.g., a binary mask) which can be used to extract a signal that approximates a source signal of interest (i.e., a signal from a desired source). Similar approaches have been developed based on modeling of a desired source using a mixture model where the frequency distribution of a source's signal is modeled as a mixture of a set of prototypical spectral characteristics (e.g., distribution of energy over frequency).

In some techniques, "clean" examples of a source's signal are used to determine characteristics (e.g., estimate of the prototypical spectral characteristics), which are then used in identifying the source's signal in a degraded (e.g., noisy) signal. In some techniques, "unsupervised" approaches estimate the prototypical characteristics from a degraded signal itself, or in "semi-supervised" approaches adapt previously determined prototypes from the degraded signal.

Approaches to separation of sources from a single acquired signal where two or more sources are present have used similar decomposition techniques. In some such approaches, each source is associated with a different set of prototypical spectral characteristics. A multiple-source signal is then analyzed to determine which time/frequency components are associated with a source of interest, and that portion of the signal is extracted as the desired signal.

As with separation of a single source from a single acquired signal, some approaches to multiple-source separation using prototypical spectral characteristics make use of unsupervised analysis of a signal (e.g., using the Expectation-Maximization (EM) Algorithm, or variants including joint Hidden Markov Model training for multiple sources), for instance to fit a parametric probabilistic model to one or more of the signals.

Other approaches to forming time-frequency masks have also been used for upmixing audio and for selection of desired sources using "audio scene analysis" and/or prior knowledge of the characteristics of the desired sources.

SUMMARY

In one aspect, in general, a microphone with closely spaced elements is used to acquire multiple signals from which a signal from a desired source is separated. For example, a signal from a desired source is separated from background noise or from signals from specific interfering sources. The signal separation approach uses a combination of direction-of-arrival information or other information determined from variation such as phase, delay, and amplitude among the acquired signals, as well as structural information for the signal from the source of interest and/or for the interfering signals. Through this combination of information, the elements may be spaced more closely than may be effective for conventional beamforming approaches. In some examples, all the microphone elements are integrated into a single a micro-electrical-mechanical system (MEMS).

In another aspect, in general, an audio signal separation system for signal separation according to source in an acoustic signal includes a micro-electrical-mechanical system (MEMS) microphone unit. The microphone unit includes multiple acoustic ports. Each acoustic port is for sensing an acoustic environment at a spatial location relative to microphone unit. In at least some examples, the minimum spacing between the spatial locations is less than 3 millimeters. The microphone unit also includes multiple microphone elements, each coupled to an acoustic port of the multiple acoustic to acquire a signal based on an acoustic environment at the spatial location of said acoustic port. The microphone unit further includes circuitry coupled to the microphone elements configured to provide one or more microphone signals together representing a representative acquired signal and a variation among the signals acquired by the microphone elements.

Aspects can include one or more of the following features.

The one or more microphone signals comprise multiple microphone signals, each microphone signal corresponding to a different microphone element.

The microphone unit further comprises multiple analog interfaces, each analog interface configured to provide one analog microphone signal of the multiple microphone signals.

The one or more microphone signals comprise a digital signal formed in the circuitry of the microphone unit.

The variation among the one or more acquired signals represents at least one of a relative phase variation and a relative delay variation among the acquired signals for each of multiple spectral components. In some examples, the spectral components represent distinct frequencies or frequency ranges. In other examples, spectral components may be based on cepstral decomposition or wavelet transforms.

The spatial locations of the microphone elements are coplanar locations. In some examples, the coplanar locations comprise a regular grid of locations.

The MEMS microphone unit has a package having multiple surface faces, and acoustic ports are on multiple of the faces of the package.

The signal separation system has multiple MEMS microphone units.

The signal separation system has an audio processor coupled to the microphone unit configured to process the one or more microphone signals from the microphone unit and to output one or more signals separated according to corresponding one or more sources of said signals from the representative acquired signal using information determined from the variation among the acquired signals and signal structure of the one or more sources.

At least some circuitry implementing the audio processor is integrated with the MEMS of the microphone unit.

The microphone unit and the audio processor together form a kit, each implemented as an integrated device configured to communicate with one another in operation of the audio signal separation system.

The signal structure of the one or more sources comprises voice signal structure. In some examples, this voice signal structure is specific to an individual, or alternatively the structure is generic to a class of individuals or a hybrid of specific and hybrid structure.

The audio processor is configured to process the signals by computing data representing characteristic variation among the acquired signals and selecting components of the representative acquired signal according to the characteristic variation.

The selected components of the signal are characterized by time and frequency of said components.

The audio processor is configured to compute a mask having values indexed by time and frequency. Selecting the components includes combining the mask values with the representative acquired signal to form at least one of the signals output by the audio processor.

The data representing characteristic variation among the acquired signals comprises direction of arrival information.

The audio processor comprises a module configured to identify components associated with at least one of the one or more sources using signal structure of said source.

The module configured to identify the components implements a probabilistic inference approach. In some examples, the probabilistic inference approach comprises a Belief Propagation approach.

The module configured to identify the components is configured to combine direction of arrival estimates of multiple components of the signals from the microphones to select the components for forming the signal output from the audio processor.

The module configured to identify the components is further configured to use confidence values associated with the direction of arrival estimates.

The module configured to identity the components includes an input for accepting external information for use in identifying the desired components of the signals. In some examples, the external information comprises user provided information. For example, the user may be a speaker whose voice signal is being acquired, a far end user who is receiving a separated voice signal, or some other person.

The audio processor comprises a signal reconstruction module for processing one or more of the signals from the microphones according to identified components characterized by time and frequency to form the enhanced signal. In some examples, the signal reconstruction module comprises a controllable filter bank.

In another aspect, in general, a micro-electro-mechanical system (MEMS) microphone unit includes a plurality of independent microphone elements with a corresponding plurality of ports with minimum spacing between ports less than 3 millimeters, wherein each microphone element generates a separately accessible signal provided from the microphone unit.

Aspects may include one or more of the following features.

Each microphone element is associated with a corresponding acoustic port.

At least some of the microphone elements share a backvolume within the unit.

The MEMS microphone unit further includes signal processing circuitry coupled to the microphone elements for providing electrical signals representing acoustic signals received at the acoustic ports of the unit.

In another aspect, in general, a multiple-microphone system uses a set of closely spaced (e.g., 1.5-2.0 mm spacing in a square arrangement) microphones on a monolithic device, for example, four MEMS microphones on a single substrate, with a common or partitioned backvolume. Because of the close spacing, phase difference and/or direction of arrival estimates may be noisy. These estimates are processed using probabilistic inference (e.g., Belief Propagation (B.P.) or iterative algorithms) to provide less "noisy" (e.g., due to additive noise signals or unmodeled effect) estimates from which a time-frequency mask is constructed.

The B.P. may be implemented using discrete variables (e.g., quantizing direction of arrival to a set of sectors). A discrete factor graph may be implemented using a hardware accelerator, for example, as described in US2012/

0317065A1 "PROGRAMMABLE PROBABILITY PROCESSING," which is incorporated herein by reference.

The factor graph can incorporate various aspects, including hidden (latent) variables related to source characteristics (e.g., pitch, spectrum, etc.) which are estimated in conjunction with direction of arrival estimates. The factor graph spans variables across time and frequency, thereby improving the direction of arrival estimates, which in turn improves the quality of the masks, which can reduce artifacts such as musical noise.

The factor graph/B.P. computation may be hosted on the same signal processing chip that processes the multiple microphone inputs, thereby providing a low power implementation. The low power may enable battery operated "open microphone" applications, such as monitoring for a trigger word.

In some implementations, the B.P. computation provides a predictive estimate of direction of arrival values which control a time domain filterbank (e.g., implemented with Mitra notch filters), thereby providing low latency on the signal path (as is desirable for applications such as speakerphones).

Applications include signal processing for speakerphone mode for smartphones, hearing aids, automotive voice control, consumer electronics (e.g., television, microwave) control and other communication or automated speech processing (e.g., speech recognition) tasks.

Advantages of one or more aspects can include the following.

The approach can make use of very closely spaced microphones, and other arrangements that are not suitable for traditional beamforming approaches.

Machine learning and probabilistic graphical modeling techniques can provide high performance (e.g., high levels of signal enhancement, speech recognition accuracy on the output signal, virtual assistant intelligibility etc.)

The approach can decrease error rate of automatic speech recognition, improve intelligibility in speakerphone mode on a mobile telephone (smartphone), improve intelligibility in call mode, and/or improve the audio input to verbal wakeup. The approach can also enable intelligent sensor processing for device environmental awareness. The approach may be particularly tailored for signal degradation cause by wind noise.

In a client-server speech recognition architecture in which some of the speech recognition is performed remotely from a device, the approach can improve automatic speech recognition with lower latency (i.e. do more in the handset, less in the cloud).

The approach can be implemented as a very low power audio processor, which has a flexible architecture that allows for algorithm integration, for example, as software. The processor can include integrated hardware accelerators for advanced algorithms, for instance, a probabilistic inference engine, a low power FFT, a low latency filterbank, and mel frequency cepstral coefficient (MFCC) computation modules.

The close spacing of the microphones permits integration into a very small package, for example, 5×6×3 mm.

Other features and advantages of the invention are apparent from the following description, and from the claims.

DESCRIPTION

Figure 2A:
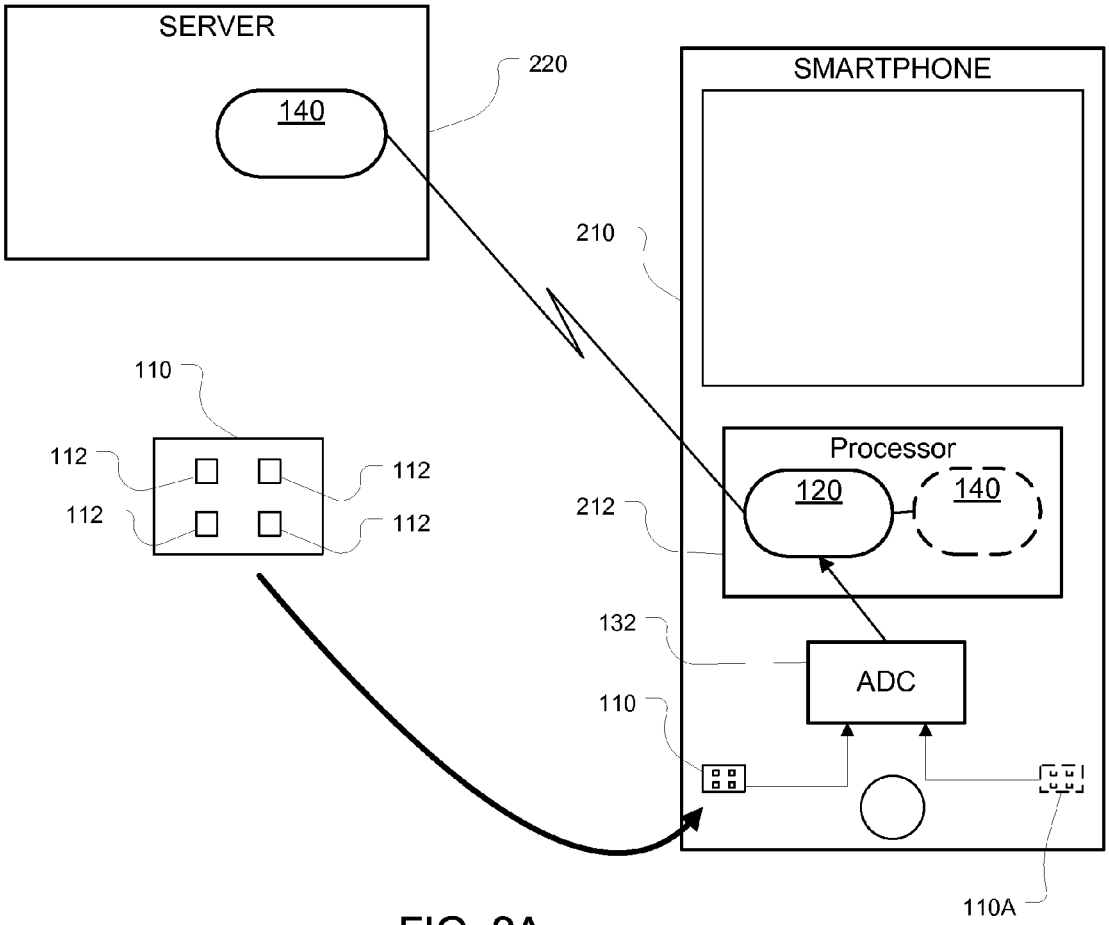
FIG. 2A is a diagram of a smartphone application.
Figure 2B:
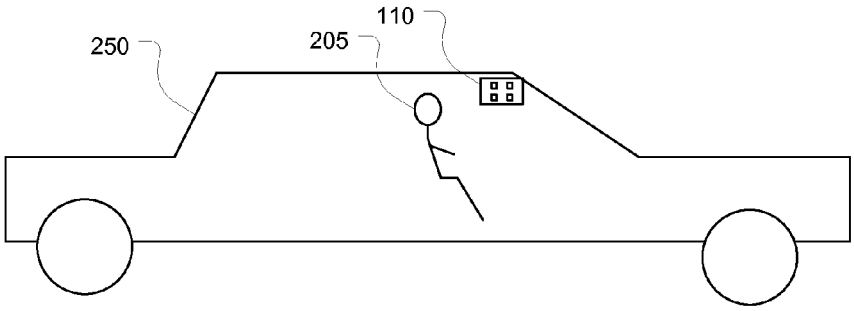
FIG. 2B is a diagram of an automotive application.

In general, a number of embodiments described herein are directed to a problem of receiving audio signals (e.g., acquiring acoustic signals) and processing the signals to separate out (e.g., extract, identify) a signal from a particular source, for example, for the purpose of communicating the extracted audio signal over a communication system (e.g., a telephone network) or for processing using a machine-based analysis (e.g., automated speech recognition and natural language understanding). Referring to FIGS. 2A-B, applications of these approaches may be found in personal computing device, such as a smartphone 210 for acquisition and processing of a user's voice signal using microphone 110, which has multiple elements 112, (optionally including one or more additional multielement microcrohones 110A), or in a vehicle 250 processing a driver's voice signal. As described further below, the microphone(s) pass signals to an analog-to-digital converter 132, and the signals are then processed using a processor 212, which implements a signal processing unit 120 and makes use of an inference processor 140, which may be implemented using the processor 212, or in some embodiments may be implemented at least in part in special-purpose circuitry or in a remote server 220. Generally, the desired signal from the source of interest is embedded with other interfering signals in the acquired microphone signals. Examples of interfering signals include voice signals from other speakers and/or environmental noises, such as vehicle wind or road noise. In general, the approaches to signal separation described herein should be understood to include or implement, in various embodiments, signal enhancement, source separation, noise reduction, nonlinear beamforming, and/or other modifications to received or acquired acoustic signals.

Information that may be used to separate the signal from the desired source from the interfering signal includes direction-of-arrival information as well as expected structural information for the signal from the source of interest and/or for the interfering signals. Direction-of-arrival information includes relative phase or delay information that relates to the differences in signal propagation time between a source and each of multiple physically separated acoustic sensors (e.g., microphone elements).

Regarding terminology below, the term "microphone" is used generically, for example, to refer to an idealized acoustic sensor that measures sound at a point as well as to refer to an actual embodiment of a microphone, for example, made as a Micro-Electro-Mechanical System (MEMS), having elements that have moving micro-mechanical diaphrams that are coupled to the acoustic environment through acoustic ports. Of course, other microphone technologies (e.g., optically-based acoustic sensors) may be used.

As a simplified example, if two microphones are separated by a distance d, then a signal that arrives directly from a source at 90 degrees to the line between them will be received with no relative phase or delay, while a signal that arrives from a distant source at $\theta=45$ degrees has a path difference of $l=d \sin \theta$, then the difference in propagation time is $l/c$, where c is the speed of sound (343 m/s at 20 degrees temperature). So the relative delay for microphones separated by d=3 mm and an angle of incidence of $\theta=45$ degrees is about $(d \sin \theta)/c=6$ ms, and with for a wavelength $\lambda$ corresponds to a phase difference of $\phi=2\pi l/\lambda=(2\pi d/\lambda)\sin\theta$. For example, for a separation of d=3 mm, and a wavelength of $\lambda$=343 mm (e.g., the wavelength of a 1000 Hz signal), the phase difference is $\phi$=0.038 radians, or $\phi$=2.2 degrees. It should be recognized that estimation of a such a small delay or phase difference in a time-varying input signal may result in local estimates in time and frequency that have relatively high error (estimation noise). Note that with greater separation, the delay and relative phase increases, such that if the microphone elements were separated by d=30 mm rather than d=3 mm, then the phase difference in the example above would be $\phi$=22 degrees rather than $\phi$=2.2 degrees. However, as discussed below, there are advantages to closely spacing the microphone elements that may outweigh greater phase difference, which may be more easily estimated. Note also that at higher frequencies (e.g., ultrasound), a 100 kHz signal at 45 degrees angle of incidence has a phase difference of about $\phi$=220 degrees, which can be estimated more reliably even with a d=3 mm sensor separation.

If a direction of arrival has two degrees of freedom (e.g., azimuth and elevation angles) then three microphones are needed to determine a direction of arrival (conceptually to within one of two images, one on either side of the plane of the microphones).

It should be understood that in practice, the relative phase of signals received at multiple microphones do not necessarily follow an idealized model of the type outlined above. Therefore when the term direction-of-arrival information is used herein, it should be understood broadly to include information that manifests the variation between the signal paths from a source location to multiple microphone elements, even if a simplified model as introduced above is not followed. For example, as discussed below with reference to at least one embodiment, direction of arrival information may include a pattern of relative phase that is a signature of a particular source at a particular location relative to the microphone, even of that pattern doesn't follow the simplified signal propagation model. For example, acoustic paths from a source to the microphones may be affected by the shapes of the acoustic ports, recessing of the ports on a face of a device (e.g., the faceplate of a smartphone), occlusion by the body of a device (e.g., a source behind the device), the distance of the source, reflections (e.g., from room walls) and other factors that one skilled in the art of acoustic propagation would recognize.

Another source of information for signal separation comes from the structure of the signal of interest and/or structure of interfering sources. The structure may be known based on an understanding of the sound production aspects of the source and/or may be determined empirically, for example during operation of the system. Examples of structure of a speech source may include aspects such as the presence of harmonic spectral structure due to period excitation during voiced speech, broadband noise-like excitation during fricatives and plosives, and spectral envelopes that have particular speech-like characteristics, for example, with characteristic formant (i.e., resonant) peaks. Speech sources may also have time-structure, for example, based on detailed phonetic content of the speech (i.e., the acoustic-phonetic structure of particular words spoken), or more generally a more coarse nature including a cadence and characteristic timing and acoustic-phonetic structure of a spoken language. Non-speech sound sources may also have known structure. In an automotive example, road noise may have a characteristic spectral shape, which may be a function of driving conditions such as speed, or windshield wipers during a rainstorm may have a characteristic periodic nature. Structure that may be inferred empirically may include specific spectral characteristics of a speaker (e.g., pitch or overall spectral distribution of a speaker of interest or an interfering speaker), or spectral characteristic of an interfering noise source (e.g., an air conditioning unit in a room).

A number of embodiments below make use of relatively closely spaced microphones (e.g., d≤3 mm). This close spacing may yield relatively unreliable estimates of direction of arrival as a function of time and frequency. Such direction of arrival information may not alone be adequate for separation of a desired signal based on its direction of arrival. Structure information of signals also may not alone be adequate for separation of a desired signal based on its structure or the structure of interfering signals.

A number of the embodiments make joint use of direction of arrival information and sound structure information for source separation. Although neither the direction information nor the structure information alone may be adequate for good source separation, their synergy provides a highly effective source separation approach. An advantage of this combined approach is that widely separated (e.g., 30 mm) microphones are not necessarily required, and therefore an integrated device with multiple closely space (e.g., 1.5 mm, 2 mm, 3 mm spacing) integrated microphone elements may be used. As examples, in a smartphone application, use of integrated closely spaced microphone elements may avoid the need for multiple microphones and corresponding opening for their acoustic ports in a faceplace of the smartphone, for example, at distant corners of the device, or in a vehicle application, a single microphone location on a headliner or rearview mirror may be used. Reducing the number of microphone locations (i.e., the locations of microphone devices each having multiple microphone elements) can reduce the complexity of interconnection circuitry, and can provide a predictable geometric relationship between the microphone elements and matching mechanical and electrical characteristics that may be difficult to achieve when multiple separate microphones are mounted separately in a system.

Figure 1:
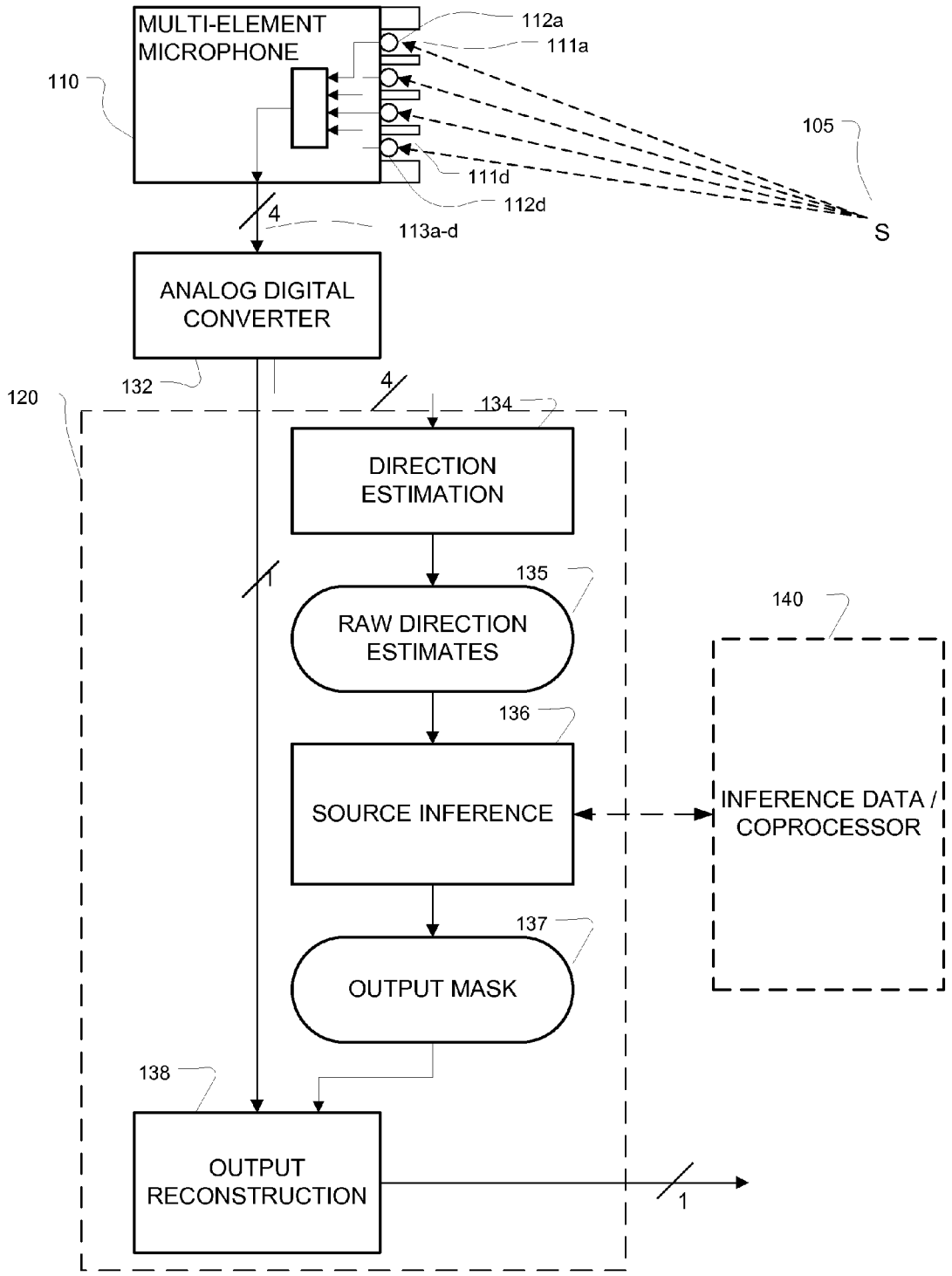
FIG. 1 is a block diagram of a source separation system.

Referring to FIG. 1, an implementation of an audio processing system 100 makes use of a combination of technologies as introduced above. In particular, the system makes use of a multi-element microphone 110 that senses acoustic signals at multiple very closely spaced (e.g., in the millimeter range) points. Schematically, each microphone element 112*a-d* senses the acoustic field via an acoustic port 111*a-d* such that each element senses the acoustic field at a different location (optionally as well or instead with different directional characteristics based on the physical structure of the port). In the schematic illustration of FIG. 1, the microphone elements are shown in a linear array, but of course other planar or three-dimensional arrangements of the elements are useful.

The system also makes use of an inference system 136, for instance that uses Belief Propagation, that identifies components of the signals received at one or more of the microphone elements, for example according to time and frequency, to separate a signal from a desired acoustic source from other interfering signals. Note that in the discussion below, the approaches of accepting multiple signals from closely-spaced microphones and separating the signals are described together, but they can be used independently of one another, for example, using the inference component with more widely spaced, or using a microphone with multiple closely spaced elements with a different approach to determining a time-frequency map of a desired components. Furthermore, the implementation is described in the context of generating an enhanced desired signal, which may be suitable for use in a human-to-human communication system (e.g., telephony) by limiting the delay introduced in the acoustic to output signal path. In other implementations, the approach is used in a human-to-machine communication system in which latency may not be as great an issue. For example, the signal may be provided to an automatic speech recognition or understanding system.

Referring to FIG. 1, in one implementation, four parallel audio signals are acquired by the MEMS multi-microphone unit 110 and passed as analog signals (e.g., electric or optical signals on separate wires or fibers, or multiplexed on a common wire or fiber) $x_1(t), \ldots, x_4(t)$ 113*a-d* to a signal processing unit 120. The acquired audio signals include components originating from a source S 105, as well as components originating from one or more other sources (not shown). In the example illustrated below, the signal processing unit 120 outputs a single signal that attempts to best separate the signal originating from the source S from other signals. Generally, the signal processing unit makes use of an output mask 137, which represents a selection (e.g., binary or weighted) as a function of time and frequency of components of the acquired audio that is estimated to originate from the desired source S. This mask is then used by an output reconstruction element 138 to form the desired signal.

As a first stage, the signal processing unit 120 includes an analog-to-digital converter. It should be understood that in other implementations, the raw audio signals each may be digitized within the microphone (e.g., converted into multibit numbers, or into a binary ΣΔ stream) prior to being passed to the signal processing unit, in which case the input interface is digital and the full analog-to-digital conversion is not needed in the signal processing unit. In other implementations, the microphone element may be integrated together with some or all of the signal processing unit, for example, as a multiple chip module, or potentially integrated on common semiconductor wafer.

Figure 3:
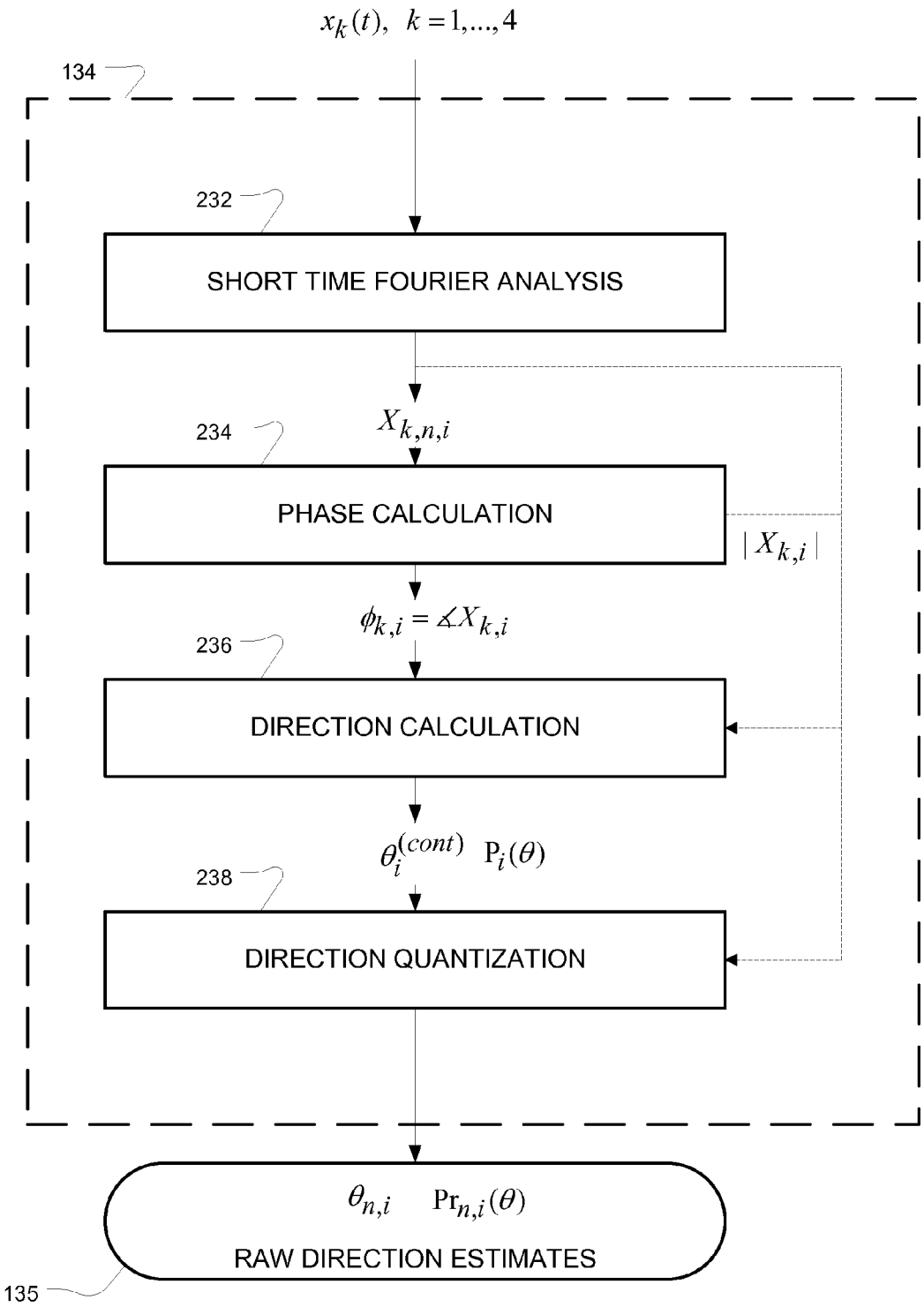
FIG. 3 is a block diagram of a direction of arrival computation.

The digitized audio signals are passed from the analog-to-digital converter to a direction estimation module 134, which generally determines an estimate of a source direction or location as a function of time and frequency. Referring to FIG. 3, the direction estimation module takes the k input signals $x_1(t), \ldots, x_k(t)$, and performs short-time Fourier Transform (STFT) analysis 232 independently on each of the input signals in a series of analysis frames. For example the frames are 30 ms in duration, corresponding to 1024 samples at a sampling rate of 16 kHz. Other analysis windows could be used, for example, with shorter frames being used to reduce latency in the analysis. The output of the analysis is a set of complex quantities $X_{k,n,i}$, corresponding to the $k^{th}$ microphone, $n^{th}$ frame and the $i^{th}$ frequency component. Other forms of signal processing may be used to determine the direction of arrival estimates, for example, based on time-domain processing, and therefore the short-time Fourier analysis should not be considered essential or fundamental.

The complex outputs of the Fourier analysis 232 are applied to a phase calculation 234. For each microphone-frame-frequency (k, n, i) combination, a phase $\phi_{k,i}=\measuredangle X_{k,i}$ is calculated (omitting the subscript n here and following) from the complex quantity. In some alternatives, the magnitudes $|X_{k,i}|$ are also computed for use by succeeding modules.

In some examples, the phases of the four microphones $\phi_{k,i}=\measuredangle X_{k,i}$ are processed independently for each frequency to yield a best estimate of the direction of arrival $\theta_i^{(cont)}$ represented as a continuous or finely quantized quantity. In this example, the direction of arrival is estimated with one degree or freedom, for example, corresponding to a direction of arrival in a plane. In other examples, the direction may be represented by multiple angles (e.g., a horizontal/azimuth and a vertical/elevation angle, or as a vector in rectangular coordinates), and may represent a range as well as a direction. Note that as described further below in association with the design characteristics of the microphone element, with more than three audio signals and a single angle representation, the phases of the input signals may over-constrain the direction estimate, and a best fit (optionally also representing a degree of fit) of the direction of arrival may be used, for example as a least squares estimate. In some examples, the direction calculation also provides a measure of the certainty (e.g., a quantitative degree of fit) of the direction of arrival, for example, represented as a parameterized distribution $P_i(\theta)$, for example parameterized by a mean and a standard deviation or as an explicit distribution over quantized directions of arrival. In some examples, the direction of arrival estimation is tolerant of an unknown speed of sound, which may be implicitly or explicitly estimated in the process of estimating a direction of arrival.

An example of a particular direction of arrival calculation approach is as follows. The geometry of the microphones is known a priori and therefore a linear equation for the phase of a signal each microphone can be represented as $\vec{a}_k \cdot \vec{d}+\delta_0=\delta_k$, where $\vec{a}_k$ is the three-dimensional position of the $k^{th}$ microphone, $\vec{d}$ is a three-dimensional vector in the direction of arrival, $\delta_0$ is a fixed delay common to all the microphones, and $\delta_k=\phi_k/\omega_i$ is the delay observed at the $k^{th}$ microphone for the frequency component at frequency $\omega_i$. The equations of the multiple microphones can be expressed as a matrix equation Ax=b where A is a K×4 matrix (K is the number of microphones) that depends on the positions of the microphones, x represent the direction of arrival (a 4-dimensional vector having $\vec{d}$ augmented with a unit element), and b is a vector that represents the observed K phases. This equation can be solved uniquely when there are four non-coplanar microphones. If there are a different number of microphones or this independence isn't satisfied, the system can be solved in a least squares sense. For fixed geometry the pseudoinverse P of A can be computed once (e.g., as a property of the physical arrangement of ports on the microphone) and hardcoded into computation modules that implement an estimation of direction of arrival x as Pb.

One issue that remains in certain embodiments is that the phases are not necessarily unique quantities. Rather, each is only determined up to a multiple of 2π. So one can unwrap the phases in infinitely many different ways, adding any multiple of 2π to any of them and then do a computation of the type above. To simplify this issue in a number of embodiments the fact that the microphones are closely spaced, less than a wavelength apart is exploited to avoid having to deal with phase unwrapping. Thus the difference between any of two unwrapped phases cannot be more than 2π (or in intermediate situations, a small multiple of 2π). This reduces the number of possible unwrappings from infinitely many to a finite number: one for each microphones, corresponding to that microphones being hit first by the wave. If one plots the phases around the unit circle, this corresponds to exploiting the fact that a particular microphone is hit first, then moving around the circle one comes to the phase value of another microphone so that another is hit next, etc.

Alternatively, directions corresponding to all the possible unwrappings are computed and the most accurate is retained, but most often a simple heuristic to pick which of these unwrappings to use is quite effective. The heuristic is to assume that all the microphones will be hit in quick succession (i.e., they are much less than a wavelength apart), so we find the longest arc of the unit circle between any two phases is first found as the basis for the unwraping. This method minimizes the difference between the largest and smallest unwrapped phase values.

In some implementations, an approach described in International Application No. PCT/US2013/060044, titled "SOURCE SEPARATION USING A CIRCULAR MODEL," is used to address the direction of arrival without explicitly requiring unwrapping, rather using a circular phase model. Some of these approaches exploit the observation that each source is associated with a linear-circular phase characteristic in which the relative phase between pairs of microphones follows a linear (modulo $2\pi$) pattern as a function of frequency. In some examples, a modified RANSAC (Random Sample Consensus) approach is used to identify the frequency/phase samples that are attributed to each source. In some examples, either in combination with the modified RANSAC approach or using other approaches, a wrapped variable representation is used to represent a probability density of phase, thereby avoiding a need to "unwrap" phase in applying probabilistic techniques to estimating delay between sources.

Several auxiliary values may also be calculated in the course of this procedure to determine a degree of confidence in the computed direction. The simplest is the length of that longest arc: if it is long (a large fraction of $2\pi$) then we can be confident in our assumption that the microphones were hit in quick succession and the heuristic unwrapped correctly. If it is short a lower confidence value is fed into the rest of the algorithm to improve performance. That is, if lots of bins say "I'm almost positive the bin came from the east" and a few nearby bins say "Maybe it came from the north, I don't know", we know which to ignore.

Another auxiliary value is the magnitude of the estimated direction vector ($\vec{d}$ above). Theory predicts this should be inversely proportional to the speed of sound. We expect some deviation from this due to noise, but too much deviation for a given bin is a hint that our assumption of a single plane wave has been violated there, and so we should not be confident in the direction in this case either.

As introduced above, in some alternative examples, the magnitudes $|X_{k,i}|$ are also provided to the direction calculation, which may use the absolute or relative magnitudes in determining the direction estimates and/or the certainty or distribution of the estimates. As one example, the direction determined from a high-energy (equivalently high amplitude) signal at a frequency may be more reliable than if the energy were very low. In some examples, confidence estimates of the direction of arrival estimates are also computed, for example, based on the degree of fit of the set of phase differences and the absolute magnitude or the set of magnitude differences between the microphones.

In some implementations, the direction of arrival estimates are quantized, for example in the case of a single angle estimate, into one of 16 uniform sectors, $\theta_i$=quantize ($\theta_i^{(cont)}$). In the case of a two-dimensional direction estimate, two angles may be separately quantized, or a joint (vector) quantization of the directions may be used. In some implementations, the quantized estimate is directly determined from the phases of the input signals. In some examples, the output of the direction of arrival estimator is not simply the quantized direction estimate, but rather a discrete distribution $Pr_i(\theta)$ (i.e., a posterior distribution give the confidence estimate. For example, at low absolute magnitude, the distribution for direction of arrival may be broader (e.g., higher entropy) than with the magnitude is high. As another example, if the relative magnitude information is inconsistent with the phase information, the distribution may be broader. As yet another example, lower frequency regions inherently have broader distributions because the physics of audio signal propagation.

Referring again to FIG. 1, the raw direction estimates 135 (e.g., on a time versus frequency grid) are passed to a source inference module 136. Note that the inputs to this module are essentially computed independently for each frequency component and for each analysis frame. Generally, the inference module uses information that is distributed over time and frequency to determine the appropriate output mask 137 from which to reconstruct the desired signal.

One type of implementation of the source inference module 136 makes use of probabilistic inference, and more particularly makes use of a belief propagation approach to probabilistic inference. This probabilistic inference can be represented as a factor graph in which the input nodes correspond to the direction of arrival estimates $\theta_{n,i}$ for a current frame $n=n_0$ and the set of frequency components i as well as for a window for prior frames $n=n_0-W, \ldots, n_0-1$ (or including future frames in embodiments that perform batch processing). In some implementations, there is a time series of hidden (latent) variables $S_{n,i}$ that indicate whether the (n, i) time-frequency location corresponds to the desired source. For example, S is a binary variable with 1 indicating the desired source and 0 indicating absence of the desired source. In other examples, a larger number of desired and/or undesired (e.g., interfering) sources are represented in this indicator variable.

One example of a factor graph introduces factors coupling $S_{n,i}$ with a set of other indicators $\{S_{m,j};|m-n|\leq 1,|i-j|\leq 1\}$. This factor graph provides a "smoothing," for example, by tending to create contiguous regions of time-frequency space associated with distinct sources. Another hidden variable characterizes the desired source. For example, an estimated (discretized) direction of arrival $\theta_S$ is represented in the factor graph.

More complex hidden variables may also be represented in the factor graph. Examples include a voicing pitch variable, an onset indicator (e.g., used to model onsets that appear over a range of frequency bins, a speech activity indicator (e.g., used to model turn taking in a conversation), spectral shape characteristics of the source (e.g., as a long-term average or obtained as a result of modeling dynamic behavior of changes of spectral shape during speech).

In some implementations, external information is provided to the source inference 136 module of the signal processing unit 120. As one example, constraint on the direction of arrival is provided by the users of a device that houses the microphone, for example, using a graphical interface that presents a illustration of a 360 degree range about the device and allows selection of a sector (or multiple sectors) of the range, or the size of the range (e.g., focus), in which the estimated direction of arrival is permitted or from which the direction of arrival is to be excluded. For example, in the case of audio input for the purpose of hands-free communication with a remote party, the user at the device acquiring the audio may select a direction to exclude because that is a source of interference. In some applications, certain directions are known a priori to represent directions of interfering sources and/or directions in which a desired source is not permitted. For example, in an automobile application in which the microphone is in a fixed location, the direction of the windshield may be known a priori to be a source of noise to be excluded, and the head-level locations of the driver and passenger are known to be likely locations of desired sources. In some examples in which the microphone and signal processing unit are used for two-party communication (e.g., telephone communication), rather than the local user providing input that constrains or biases the input direction, the remote user provides the information based on their perception of the acquired and processed audio signals.

In some implementations, motion of the source (and/or orientation of the microphones relative to the source or to a fixed frame of reference) is also inferred in the belief propagation processing. In some examples, other inputs, for example, inertial measurements related to changes in orientation of the microphone element are also used in such tracking. Inertial (e.g., acceleration, gravity) sensors may also be integrated on the same chip as the microphone, thereby providing both acoustic signals and inertial signals from a single integrated device.

In some examples, the source inference module 136 interacts with an external inference processor 140, which may be hosted in a separate integrated circuit ("chip") or may be in a separate computer coupled by a communication link (e.g., a wide area data network or a telecommunications network). For example, the external inference processor may be performing speech recognition, and information related to the speech characteristics of the desired speaker may be fed back to the inference process to better select the desired speaker's signal from other signals. In some cases, these speech characteristics are long-term average characteristics, such as pitch range, average spectral shape, formant ranges, etc. In other cases, the external inference processor may provide time-varying information based on short-term predictions of the speech characteristics expected from the desired speaker. One way the internal source inference module 136 and an external inference processor 140 may communicate is by exchanging messages in a combined Believe Propagation approach.

One implementation of the factor graph makes use of a "GP5" hardware accelerator as described in "PROGRAMMABLE PROBABILITY PROCESSING," US Pat. Pub. 2012/0317065A1, which is incorporated herein by reference.

An implementation of the approach described above may host the audio signal processing and analysis (e.g., FFT acceleration, time domain filtering for the masks), general control, as well as the probabilistic inference (or at least part of in—there may be a split implementation in which some "higher-level" processing is done off-chip) are implemented in the same integrated circuit. Integration on the same chip may provide lower power consumption than using a separate processor.

After the probabilistic inference described below, the result is binary or fractional mask with values $M_{n,i}$, which are used to filter one of the input signals $x_i(t)$, or some linear combination (e.g., sum, or a selectively delayed sum) of the signals. In some implementations, the mask values are used to adjust gains of Mitra notch filters. In some implementations, a signal processing approach using charge sharing as described in PCT Publication WO2012/024507, "CHARGE SHARING ANALOG COMPUTATION CIRCUITRY AND APPLICATIONS", may be used to implement the output filtering and/or the input signal processing.

Figure 4A:
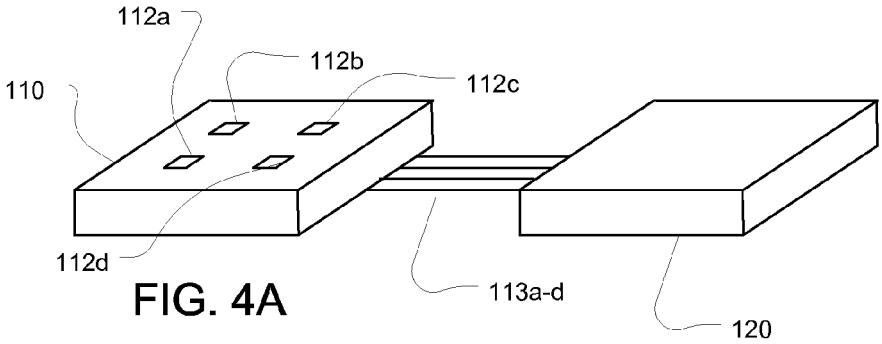
FIGS. 4A-C are views of an audio processing system.
Figure 4B:
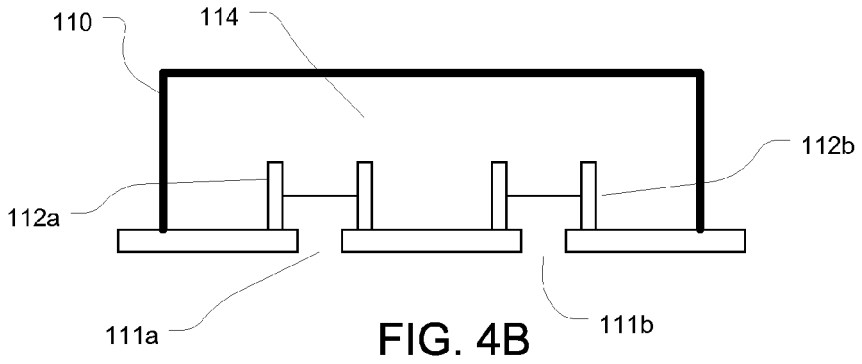
Figure 4C:
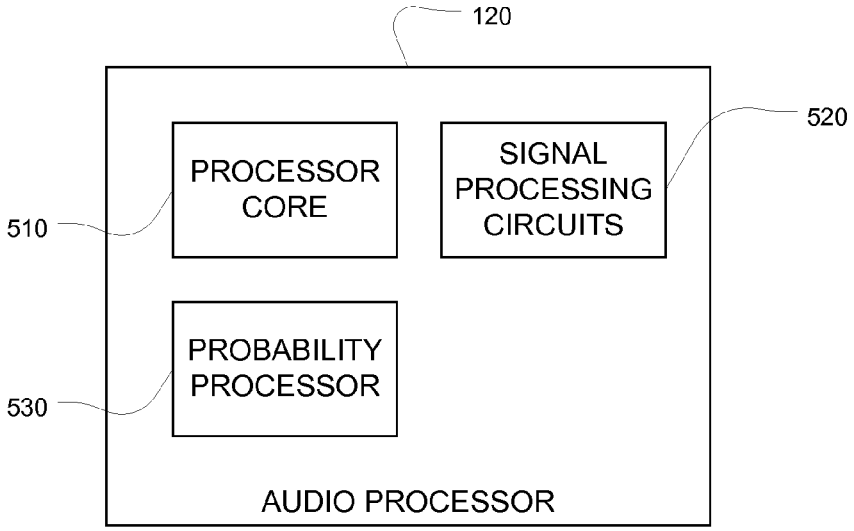

Referring to FIGS. 4A-B, an example of the microphone unit 110 uses four MEMS elements 112*a-d*, each coupled via one of four ports 111*a-d* arranged in a 1.5 mm-2 mm square configuration, with the elements either sharing a common backvolume 114. Optionally, each element has an individual partitioned backvolume. The microphone unit 110 is illustrated as connected to an audio processor 120, which in this embodiment is in a separate package. A block diagram of modules of the audio processor are shown in FIG. 4C. These include a processor core 510, signal processing circuitry 520 (e.g., to perform SFTF computation), and a probability processor 530 (e.g., to perform Belief Propagation). It should be understood that FIGS. 4A-B are schematic simplifications and many specific physical configurations and structures of MEMS elements may be used. More generally, the microphone has multiple ports, multiple elements each coupled to one or more ports, ports on multiple different faces of the microphone unit package and possible coupling between the ports (e.g., with specific coupling between ports or using one or more common backvolumes). Such more complex arrangements may combine physical directional, frequency, and/or noise cancellation characteristics with providing so suitable inputs for further processing.

In one embodiment of a source separation approach used in the source inference component 136 (see FIG. 1), an input comprises a time versus frequency distribution P(f,n). The values of this distribution are non-negative, and in this example, the distribution is over a discrete set of frequency values $f \in [1,F]$ and time values $n \in [1,N]$. (In general, in the description below, an integer index n represents a time analysis window or frame, e.g., of 30 ms. Duration, of the continuous input signal, with an index t representing a point in time in an underlying time base, e.g., in measured in seconds). In this examples, the value of P(f,n) is set to be proportional energy of the signal at frequency f and time n, normalized so that $\Sigma_{f,n}P(f,n)=1$. Note that the distribution P(f,n) may take other forms, for instance, spectral magnitude, powers/roots of spectral magnitude or energy, or log spectral energy, and the spectral representation may incorporate pre-emphasis, In addition to the spectral information, direction of arrival information is available on the same set of indices, for example as direction of arrival estimates D(f,n). In this embodiment, as introduced above, these direction of arrival estimates are discretized values, for example $d \in [1,D]$ for D (e.g., 20) discrete (i.e., "binned") directions of arrival. As discussed below, in other embodiments these direction estimates are not necessarily discretized, and may represent inter-microphone information (e.g., phase or delay) rather than derived direction estimates from such inter-microphone information. The spectral and direction information are combined into a joint distribution P(f,n,d) which is non-zero only for indices where d=D(f,n).

Generally, the separation approach assumes that there are a number of sources, indexed by $s \in [1,S]$. Each source is associated with a discrete set of spectral prototypes, indexed by $z \in [1,Z]$, for example with Z=50 corresponding to each source being exclusively associated with 50 spectral prototypes. Each prototype is associated with a distribution q(f|z,s), which has non-negative values such that $\Sigma_f q(f|z,s)=1$ for all spectral prototypes (i.e., indexed by pairs $(z,s) \in [1,Z] \times [1,S]$). Each source has an associated distribution of direction values, q(d|s), which is assumed independent of the prototype index z.

Given these assumptions, an overall distribution is formed as $$Q(f, n, d) = \sum_s \sum_z q(s)q(z \mid s)q(f \mid z, s)q(n \mid z, s)q(d \mid s)$$

where q(s) is a fractional contribution of source s, q(z|s) is a distribution of prototypes z for the source s, and q(n|z,s) is the temporal distribution of the prototype z and source s.

Note that the individual distributions in the summation above are not known in advance. In this case of discrete distributions, there are S+ZS+FZS+NZS+DS=S(1+D+Z(1+F+N)) unknown values. An estimate of those distributions can be formed such that Q(f,n,d) matches the observed (empirical) distribution P(f,n,d). One approach to finding this match is to use an iterative algorithm which attempts to reach an optimal choice (typically a local optimum) of the individual distributions to maximize $$\sum_{f,n,d} P(f, n, d)\log Q(f, n, d)$$

One iterative approach to this maximization is the Expectation-Maximization algorithm, which may be iterated until a stopping condition, such as a maximum number of iterations of a degree of convergence.

Note that because the empirical distribution P(f,t,d) is sparse (recall that for most values of d the distribution is zero), the iterative computations can be optimized.

After termination of the iteration, the contribution of each source to each time/frequency element is then found as.

$$q(s \mid f, n) = \frac{q(s)\sum_z q(z \mid s)q(f \mid z, s)q(n \mid z, s)}{\sum_d Q(f, n, d)}$$

This mask may be used as a quantity between 0.0 and 1.0, or may be thresholded to form a binary mask.

A number of alternatives may be incorporated into the approach described above. For example, rather than using a specific estimate of direction, the processing of the relative phases of the multiple microphones may yield a distribution P(d|f,n) of possible direction bins, such that P(f,n,d)=P(f,n)P(d|f,n). Using such a distribution can provide a way to represent the frequency-dependency of the uncertainty of a direction of arrival estimate.

Other decompositions can effectively make use of similar techniques. For example, a form $$Q(f,n,d)=q(d|s)q(f|z,s)q(n,z,s)$$

where each of the distributions is unconstrained.

An alternative factorization of the distribution can also make use of temporal dynamics. Note that above, the contribution of a particular source over time $q(n|s)=\Sigma_z q(n|z,s)q(z|s)$, or a particular spectral prototype over time q(n|z), is relatively unconstrained. In some examples, temporal structure may be incorporated, for example, using a Hidden Markov Model. For example, evolution of the contribution of a particular source may be governed by an hidden Markov chain $X=x_1, \ldots, x_N$, and in each state $x_n$ may be characterized by a distribution $q(z|x_n)$. Furthermore, the temporal variation q(n|X) may follow dynamic model that depends on the hidden state sequence. Using such an HMM approach, the distribution q(n,z,s) may be then determined as the probability that source s is emitting it's spectral prototype z at frame n. The parameters of the Markov chains for the sources can be estimated using a Expectation-Maximization (or similar Baum-Welch) algorithm.

As introduced above, directional information provided as a function of time and frequency is not necessarily discretized into one of D bins. In one such example, D(f,n) is real valued estimate, for example, a radian value between 0.0 and π or a degree value from 0.0 to 180.0 degrees. In such an example, the model q(d|s) is also continuous, for example, being represented as a parametric distribution, for example, as a Gaussian distribution. Furthermore, in some examples, a distributional estimate of the direction of arrival is obtained, for example, as P(d|f,n), which is a continuous valued distribution of the estimate of the direction of arrival d of the signal at the (f,n) frequency-time bin. In such a case, P(f,n,d) is replaced by the product P(f,n)P(d|f,n), and the approach is modified to effective incorporate integrals over continuous range rather than sums over the discrete set of binned directions.

In some examples, raw delays (or alternatively phase differences) $\delta_k$ for each (f,n) component are used directly for example, as a vector $D(f,n)=[\delta_2-\delta_1, \ldots, \delta_K-\delta_1]$ (i.e., a K−1 dimensional vector to account for the unknown overall phase). In some examples, these vectors are clustered or vector quantized to form D bins, and processed as described above. In other examples, continuous multidimensional distributions are formed and processed in a manner similar to processing continuous direction estimates as described above.

As described above, given a number of sources S, an unsupervised approach can be used on a time interval of a signal. In some examples, such analysis can be done on successive time intervals, or in a "sliding window" manner in which parameter estimates from a past window are retained, for instance as initial estimates, for subsequent possibly overlapping windows. In some examples, single source (i.e., "clean") signals are used to estimate the model parameters for one or more sources, and these estimates are used to initialize estimates for the iterative approach described above.

In some examples, the number of sources or the association of sources with particular index values (i.e., s) is based on other approaches. For example, a clustering approach may be used on the direction information to identify a number of separate direction clusters (e.g., by a K-means clustering), and thereby determine the number of sources to be accounted for. In some examples, an overall direction estimate may be used for each source to assign the source index values, for example, associating a source in a central direction as source s=1.

In another embodiment of a source separation approach used in the source inference component 136, the acquired acoustic signals are processed by computing a time versus frequency distribution P(f,n) based on one or more of the acquired signals, for example, over a time window. The values of this distribution are non-negative, and in this example, the distribution is over a discrete set of frequency values $f\epsilon[1,F]$ and time values $n\epsilon[1,N]$. In some implementations, the value of $P(f,n_0)$ is determined using a Short Time Fourier Transform at a discrete frequency f in the vicinity of time $t_0$ of the input signal corresponding to the $n_0^{th}$ analysis window (frame) for the STFT.

In addition to the spectral information, the processing of the acquired signals also includes determining directional characteristics at each time frame for each of multiple components of the signals. One example of components of the signals across which directional characteristics are computed are separate spectral components, although it should be understood that other decompositions may be used. In this example, direction information is determined for each (f,n) pair, and the direction of arrival estimates on the indices as D(f,n) are determined as discretized (e.g., quantized) values, for example $d \in [1,D]$ for D (e.g., 20) discrete (i.e., "binned") directions of arrival.

For each time frame of the acquired signals, a directional histogram P(d|n) is formed representing the directions from which the different frequency components at time frame n originated from. In this embodiment that uses discretized directions, this direction histogram consists of a number for each of the D directions: for example, the total number of frequency bins in that frame labeled with that direction (i.e., the number of bins f for which D(f,n)=d. Instead of counting the bins corresponding to a direction, one can achieve better performance using the total of the STFT magnitudes of these bins (e.g., $P(d|n) \propto \Sigma_{f:D(f,n)=d} P(f|n)$), or the squares of these magnitudes, or a similar approach weighting the effect of higher-energy bins more heavily. In other examples, the processing of the acquired signals provides a continuous-valued (or finely quantized) direction estimate D(f,n) or a parametric or non-parametric distribution P(d|f,n), and either a histogram or a continuous distribution P(d|n) is computed from the direction estimates. In the approaches below, the case where P(d|n) forms a histogram (i.e., values for discrete values of d) is described in detail, however it should be understood that the approaches may be adapted to address the continuous case as well.

The resulting directional histogram can be interpreted as a measure of the strength of signal from each direction at each time frame. In addition to variations due to noise, one would expect these histograms to change over time as some sources turn on and off (for example, when a person stops speaking little to no energy would be coming from his general direction, unless there is another noise source behind him, a case we will not treat).

One way to use this information would be to sum or average all these histograms over time (e.g., as $\overline{P}(d)=(1/N)\Sigma_n P(d|n)$). Peaks in the resulting aggregated histogram then correspond to sources. These can be detected with a peak-finding algorithm and boundaries between sources can be delineated by for example taking the mid-points between peaks.

Another approach is to consider the collection of all directional histograms over time and analyze which directions tend to increase or decrease in weight together. One way to do this is to compute the sample covariance or correlation matrix of these histograms. The correlation or covariance of the distributions of direction estimates is used to identify separate distributions associated with different sources. One such approach makes use of a covariance of the direction histograms, for example, computed as $$Q(d_1,d_2)=(1/N)\Sigma_n(P(d_1/n)-\overline{P}(d_1))(P(d_2|n)-\overline{P}(d_2))$$

where $\overline{P}(d)=(1/N)\Sigma_n P(d|n)$, which can be represented in matrix form as $$Q=(1/N)\Sigma_n(P(n)-\overline{P})(P(n)-\overline{P})^T$$

where P(n) and $\overline{P}$ are D-dimensional column vectors.

A variety of analyses can be performed on the covariance matrix Q or on a correlation matrix. For example, the principal components of Q (i.e., the eigenvectors associated with the largest eigenvalues) may be considered to represent prototypical directional distributions for different sources.

Other methods of detecting such patterns can also be employed to the same end. For example, computing the joint (perhaps weighted) histogram of pairs of directions at a time and several (say 5—there tends to be little change after only 1) frames later, averaged over all time, can achieve a similar result.

Another way of using the correlation or covariance matrix is to form a pairwise "similarity" between pairs of directions $d_1$ and $d_2$. We view the covariance matrix as a matrix of similarities between directions, and apply a clustering method such as affinity propagation or k-medoids to group directions which correlate together. The resulting clusters are then taken to correspond to individual sources.

In this way a discrete set of sources in the environment is identified and a directional profile for each is determined. These profiles can be used to reconstruct the sound emitted by each source using the masking method described above. They can also be used to present a user with a graphical illustration of the location of each source relative to the microphone array, allowing for manual selection of which sources to pass and block or visual feedback about which sources are being automatically blocked.

Alternative embodiments can make use of one or more of the following alternative features.

Note that the discussion above makes use of discretized directional estimates. However, an equivalent approach can be based on directional distributions at each time-frequency component, which are then aggregated. Similarly, the quantities characterizing the directions are not necessarily directional estimates. For example, raw inter-microphone delays can be used directly at each time-frequency component, and the directional distribution may characterize the distribution of those inter-microphone delays for the various frequency components at each frame. The inter-microphone delays may be discretized (e.g., by clustering or vector quantization) or may be treated as continuous variables.

Instead of computing the sample covariance matrix over all time, one can track a running weighted sample mean (say, with an averaging or low-pass filter) and use this to track a running estimate of the covariance matrix. This has the advantage that the computation can be done in real time or streaming mode, with the result applied as the data comes in, rather than just in batch mode after all data has been collected.

This method will "forget" data collected from the distant past, meaning that it can track moving sources. At each time step the covariance (or equivalent) matrix will not change much, so the grouping of directions into sources also will not change much. Therefore for repeated calls to the clustering algorithm, the output from the previous call can be used for a warm start (clustering algorithms tend to be iterative), decreasing run time of all calls after the first. Also, since sources will likely move slowly relative to the length of an STFT frame, the clustering need not be recomputed as often as every frame.

Some clustering methods, such as affinity propagation, admit straightforward modifications to account for available side information. For example, one can bias the method toward finding a small number of clusters, or towards finding only clusters of directions which are spatially contiguous. In this way performance can be improved or the same level of performance achieved with less data.

The resulting directional distribution for a source may be used for a number of purposes. One use is to simply determine a number of sources, for example, by using quantities determined in the clustering approach (e.g., affinity of clusters, eigenvalue sizes, etc) and a threshold on those quantities. Another use is as a fixed directional distribution that is used in a factorization approach, as described above. Rather than using the directional distribution as being fixed, it can be used as an initial estimate in the iterative approaches described in the above-referenced incorporated application.

In another embodiment, input mask values over a set of time-frequency locations that are determined by one or more of the approaches described above. These mask values may have local errors or biases. Such errors or biases have the potential result that the output signal constructed from the masked signal has undesirable characteristics, such as audio artifacts.

Also as introduced above, one general class of approaches to "smoothing" or otherwise processing the mask values makes use of a binary Markov Random Field treating the input mask values effectively as "noisy" observations of the true but not known (i.e., the actually desired) output mask values. A number of techniques described below address the case of binary masks, however it should be understood that the techniques are directly applicable, or may be adapted, to the case of non-binary (e.g., continuous or multi-valued) masks. In many situations, sequential updating using the Gibbs algorithm or related approaches may be computationally prohibitive. Available parallel updating procedures may not be available because the neighborhood structure of the Markov Random Field does not permit partitioning of the locations in such a way as to enable current parallel update procedures. For example, a model that conditions each value on the eight neighbors in the time-frequency grid is not amenable to a partition into subsets of locations of exact parallel updating.

Another approach is disclosed herein in which parallel updating for a Gibbs-like algorithm is based on selection of subsets of multiple update locations, recognizing that the conditional independence assumption may be violated for many locations being updated in parallel. Although this may mean that the distribution that is sampled is not precisely the one corresponding to the MRF, in practice this approach provides useful results.

A procedure presented herein therefore repeats in a sequence of update cycles. In each update cycle, a subset of locations (i.e., time-frequency components of the mask) is selected at random (e.g., selecting a random fraction, such as one half), according to a deterministic pattern, or in some examples forming the entire set of the locations.

When updating in parallel in the situation in which the underlying MRF is homogeneous, location-invariant convolution according to a fixed kernel is used to compute values at all locations, and then the subset of values at the locations being updated are used in a conventional Gibbs update (e.g., drawing a random value and in at least some examples comparing at each update location). In some examples, the convolution is implemented in a transform domain (e.g., Fourier Transform domain). Use of the transform domain and/or the fixed convolution approach is also applicable in the exact situation where a suitable pattern (e.g., checkerboard pattern) of updates is chosen, for example, because the computational regularity provides a benefit that outweighs the computation of values that are ultimately not used.

Figure 5:
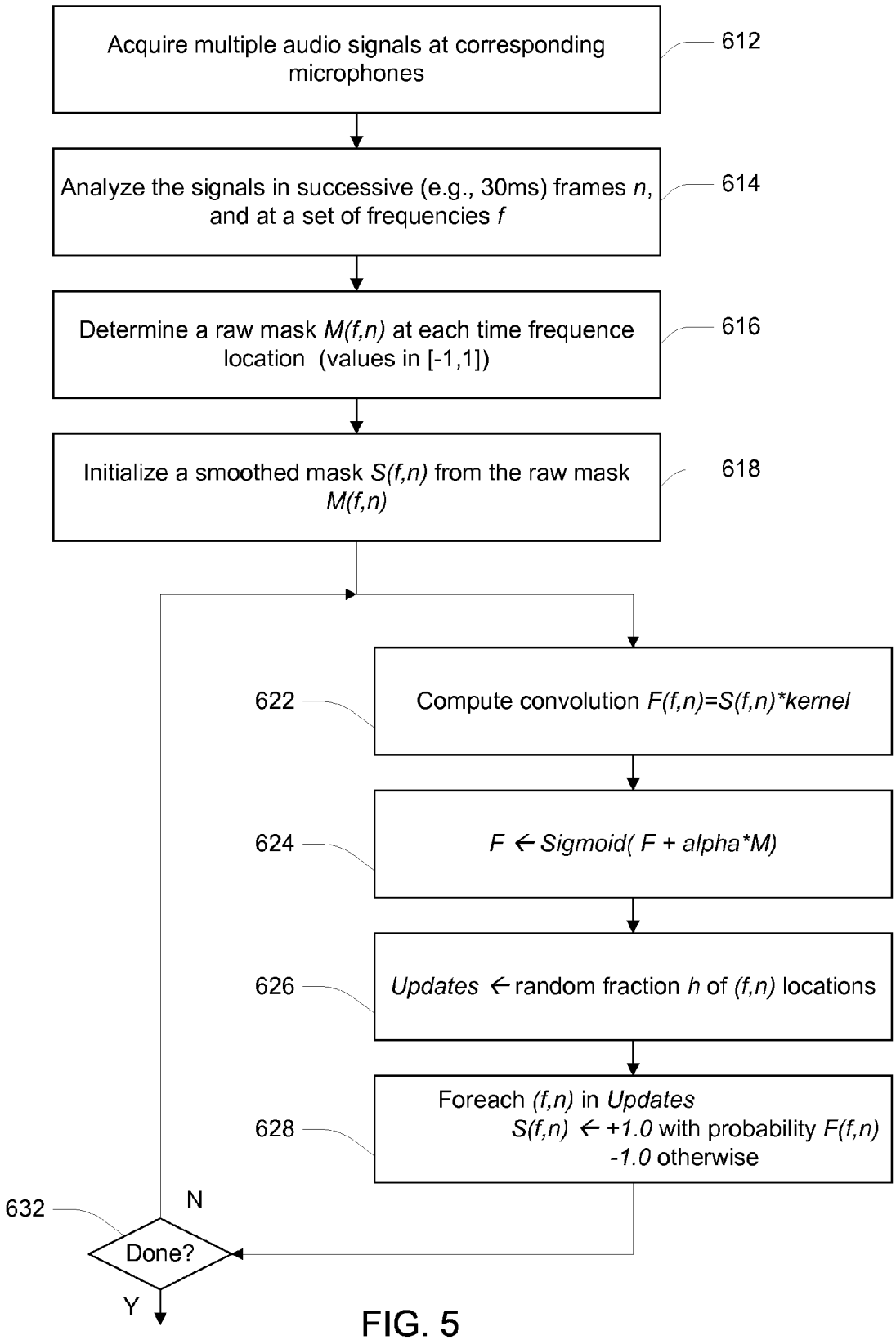
FIG. 5 is a flowchart.

A summary of the procedure is illustrated in the flowchart of FIG. 5. Note that the specific order of steps may be altered in some implementations, and steps may be implemented in using different mathematical formulations without altering the essential aspects of the approach. First, multiple signals, for instance audio signals, are acquired at multiple sensors (e.g., microphones) (step 612). In at least some implementations, relative phase information at successive analysis frames (n) and frequencies (f) is determined in an analysis step (step 614). Based on this analysis, a value between −1.0 (i.e., a numerical quantity representing "probably off") and +1.0 (i.e., a numerical quantity representing "probably on") is determined for each time-frequency location as the raw (or input) mask M(f,n) (step 616). Of course in other applications, the input mask is determined in other ways than according to phase or direction of arrival information. An output of this procedure is to determine a smoothed mask S(f,n), which is initialized to be equal to the raw mask (step 618). A sequence of iterations of further steps is performed, for example terminating after a predetermined number of iterations (e.g., 50 iterations). Each iteration begins with a convolution of the current smoothed mask with a local kernel to form a filtered mask (step 622). In some examples, this kernel extends plus and minus one sample in time and frequency, with weights:

$$\begin{bmatrix} 0.25 & 0.5 & 0.25 \\ 1.0 & 0.0 & 1.0 \\ 0.25 & 0.5 & 0.25 \end{bmatrix}$$

A filtered mask F(f,n), with values in the range 0.0 to 1.0 is formed by passing the filtered mask plus a multiple $\alpha$ times the original raw mask through a sigmoid $1/(1+\exp(-x))$ (step 124), for example, for $\alpha=2.0$. A subset of a fraction h of the (f,n) locations, for example h=0.5, is selected at random or alternatively according to a deterministic pattern (step 626). Iteratively or in parallel, the smoothed mask S at these random locations is updated probabilistically such that a location (f,n) selected to be updated is set to +1.0 with a probability F(f,n) and −1.0 with a probability (1−F(f,n)) (step 628). An end of iteration test (step 632) allows the iteration of steps 122-128 to continue, for example for a predetermined number of iterations.

A further computation (not illustrated in the flowchart of FIG. 5) is optionally performed to determine a smoothed filtered mask SF(f,n). This mask is computed as the sigmoid function applied to the average of the filtered mask computed over a trailing range of the iterations, for example, with the average computed over the last 40 of 50 iterations, to yield a mask with quantities in the range 0.0 to 1.0.

It should be understood that the approach described above for smoothing an input mask to form an output mask is applicable to a much wider range of applications than selection of time and component (e.g., frequency) indexed components of an audio signal. For example, the same approach may be used to smoothing a spatial mask for image processing, and may be used outside the domain of signal processing.

In some implementations, the procedures described above may be implemented in a batch mode, for example, by collecting a time interval of signals (e.g., several seconds, minutes, or more), and estimating the spectral components for each source as described. Such an implementation may be suitable for "off-line" analysis in which delay between signal acquisition and availability of an enhanced source-separated signal. In other implementations, a streaming mode is used in which the signals are acquired, the inference process is used to construct the source separation masks with low delay, for example, using a sliding lagging window.

After selection of the desired time-frequency components (i.e., by forming the binary or continuous-valued output mask) an enhanced signal may be formed in the time domain, for example, for audio presentation (e.g., transmission over a voice communication link) or for automated processing (e.g., using an automated speech recognition system). In some examples, the enhanced time domain signal does not have to be formed explicitly, and an automated processing may work directly on the time-frequency analysis used for the source separation steps.

The approaches described above are applicable to a variety of end applications. For example, the multi-element microphone (or multiple such microphones) are integrated into a personal communication or computing device (e.g., a "smartphone", eye-glasses based personal computer, jewelry-based or watch-based computer etc.) to support a hands-free and/or speakerphone mode. In such an application, enhanced audio quality can be achieved by focusing on the direction from which the user is speaking and/or reducing the effect of background noise. In such an application, because of typical orientations used by users to hold or wear a device while talking, prior models of the direction of arrival and/or interfering sources can be used. Such microphones may also improve human-machine communication by enhancing the input to a speech understanding system. Another example is audio capture in an automobile for human-human and/or human-machine communication. Similarly, microphones on consumer devices (e.g., on a television set, or a microwave oven) can provide enhanced audio input for voice control. Other applications include hearing aids, for example, having a single microphone at one ear and providing an enhanced signal to the user.

In some examples of separating a desired speech signal from interfering signals, the location and/or structure of at least some of the interfering signals is known. For example, in hands-free speech input at a computer while the speaker is typing, it may be possible to separate the desired voice signal from the undesired keyboard signal using both the location of the keyboard relative to the microphone, as well as a known structure of keyboard sound. A similar approach may be used to mitigate the effect of camera (e.g., shutter) noise in a camera that records user's commentary during while the user is taking pictures.

Multi-element microphones may be useful in other application areas in which a separation of a signal by a combination of sound structure and direction of arrival can be used. For example, acoustic sensing of machinery (e.g., a vehicle engine, a factory machine) may be able to pinpoint a defect, such as a bearing failure not only by the sound signature of such a failure, but also by a direction of arrival of the sound with that signature. In some cases, prior information regarding the directions of machine parts and their possible failure (i.e., noise making) modes are used to enhance the fault or failure detection process. In a related application, a typically quiet environment may be monitored for acoustic events based on their direction and structure, for example, in a security system. For example, a room-based acoustic sensor may be configured to detect glass breaking from the direction of windows in the room, but to ignore other noises from different directions and/or with different structure.

Directional acoustic sensing is also useful outside the audible acoustic range. For example an ultrasound sensor may have essentially the same structure the multiple element microphone described above. In some examples, ultrasound beacons in the vicinity of a device emit known signals. In addition to be able to triangulate using propagation time of multiple beacons from different reference location, a multiple element ultrasound sensor can also determine direction or arrival information for individual beacons. This direction of arrival information can be used to improve location (or optionally orientation) estimates of a device beyond that available using conventional ultrasound tracking. In addition, a range-finding device, which emits an ultrasound signal and then processes received echoes may be able to take advantage of the direction of arrival of the echoes to separate a desired echo from other interfering echoes, or to construct a map of range as a function of direction, all without requiring multiple separated sensors. Of course these localization and range finding techniques may also be used with signals in audible frequency range.

It should be understood that the co-planar rectangular arrangement of closely spaced ports on the microphone unit described above is only one example. In some cases the ports are not co-planar (e.g., on multiple faces on the unit, with built-up structures on one face, etc.), and are not necessarily arranged on a rectangular arrangement.

Certain modules described above may be implemented in logic circuitry and/or software (stored on a non-transitory machine-readable medium) that includes instructions for controlling a processor (e.g., a microprocessor, a controller, inference processor, etc.). In some implementations, a computer accessible storage medium includes a database representative of the system. Generally speaking, a computer accessible storage medium may include any non-transitory storage media accessible by a computer during use to provide instructions and/or data to the computer. For example, a computer accessible storage medium may include storage media such as magnetic or optical disks and semiconductor memories. Generally, the database representative of the system may be a database or other data structure which can be read by a program and used, directly or indirectly, to fabricate the hardware comprising the system. The database may include geometric shapes to be applied to masks, which may then be used in various MEMS and/or semiconductor fabrication steps to produce a MEMS device and/or semiconductor circuit or circuits corresponding to the system.

It is to be understood that the foregoing description is intended to illustrate and not to limit the scope of the invention, which is defined by the scope of the appended claims. Other embodiments are within the scope of the following claims.

What is claimed is:

1. An audio signal separation system for signal separation according to source in an acoustic signal, the system comprising:

a micro-electrical-mechanical system (MEMS) microphone unit including a plurality of acoustic ports, each port for sensing an acoustic environment at a spatial location relative to microphone unit, a minimum spacing between the spatial locations being less than 3 millimeters, a plurality of microphone elements, each coupled to an acoustic port of the plurality of acoustic ports to acquire a signal based on an acoustic environment at the spatial location of said acoustic port, and circuitry coupled to the microphone elements configured to provide one or more microphone signals together representing a representative acquired signal and a variation among the signals acquired by the microphone elements; and an audio processor configured to process the one or more microphone signals from the microphone unit to output one or more separated signals comprising signals separated according to corresponding one or more sources of said signals from the representative acquired signal, wherein the audio processor is configured to process the one or more microphone signals using direction of arrival information determined from the variation among the acquired signals and using signal structure of the one or more sources.

2. The audio signal separation system of claim 1, wherein the one or more microphone signals comprise a plurality of microphone signals, each microphone signal corresponding to a different microphone element of the plurality of microphone elements.

3. The audio signal separation system of claim 1, wherein the variation among the one or more acquired signals represents at least one of a relative phase variation and a relative delay variation among the acquired signals for each of a plurality of spectral components.

4. The audio signal separation system of claim 1, comprising a plurality of MEMS microphone units.

5. The audio signal separation system of claim 1, wherein at least some circuitry implemented the audio processor is integrated with the MEMS of the microphone unit.

6. The audio signal separation system of claim 1, wherein the microphone unit and the audio processor together form a kit, each implemented as an integrated device configured to communicate with one another in operation of the audio signal system.

7. The audio signal separation system of claim 1, wherein the signal structure of the one or more sources comprises voice signal structure.

8. The audio signal separation system of claim 1, wherein the audio processor is configured to process the signals by computing data representing characteristic variation among the acquired signals and selecting components of the representative acquired signal according to the characteristic variation.

9. The audio signal separation system of claim 8, wherein the selected components of the signal are characterized by time and frequency of said components.

10. The audio signal separation system of claim 8, wherein the audio processor is configured to compute a mask having values indexed by time and frequency, and wherein selecting the components includes combining the mask values with the representative acquired signal to form at least one of the signals output by the audio processor.

11. The audio signal separation system of claim 8, wherein data representing characteristic variation among the acquired signals comprises direction of arrival information.

12. The audio signal separation system of claim 1, wherein the audio processor comprises a module configured to identify components associated with at least one of the one or more sources using signal structure of said source.

13. The audio signal separation system of claim 12, wherein the module configured to identity the components is configured to combine direction of arrival estimates of multiple components of the signals from the microphones to select the components for forming the signal output from the audio processor.

14. The audio signal separation system of claim 13, wherein the module configured to identity the components is further configured to use confidence values associated with the direction of arrival estimates.

15. The audio signal separation system of claim 12, wherein the module configured to identity the components includes an input for accepting external information for use in identifying the desired components of the signals.

16. The audio signal separation system of claim 1, wherein the audio processor comprises a signal reconstruction module for processing one or more of the signals from the microphones according to identified components characterized by time and frequency to form the enhanced signal.

17. The audio signal separation system of claim 1, wherein the audio processor is configured to process the one or more microphone signals by using an iterative algorithm based on probabilistic inference approach and utilizing the direction of arrival information and the signal structure of the one or more sources.

18. The audio signal separation system of claim 1, wherein the audio processor is configured to process the one or more microphone signals by using an iterative algorithm configured to reach optimal spectral and temporal distributions of the one or more separated signals by iteratively updating estimated spectral and temporal distributions of the one or more separated signals to match the representative acquired signal.

19. The audio signal separation system of claim 18, wherein the audio processor is configured to perform the iterative updating until a predefined maximum number of iterations is reached or until the estimated spectral and temporal distributions of the one or more separated signals and the representative acquired signal reach a predefined degree of convergence.

20. The audio signal separation system of claim 17, wherein the probabilistic inference approach comprises a Belief Propagation approach.

21. The audio signal separation system of claim 1, wherein processing the one or more microphone signals using the direction of arrival (DOA) information and using the signal structure of the one or more sources comprises:

forming an approximation of the representative acquired signal, the approximation having a hidden multiple-source structure assuming that the representative acquired signal was generated by a number of distinct acoustic sources indexed by $s=1, \ldots, S$ and each acoustic source of the one or more sources is associated with a subset of prototype frequency distributions indexed by $z=1, \ldots, Z$ so that the approximation can be factorized into constituent parts;

performing a plurality of iterations of adjusting components of a model of the approximation to match the representative acquired signal; and generating the one or more separated signals using the constituent parts of the approximation corresponding to the one or more sources.

22. The audio signal separation system of claim 21, wherein the approximation includes the DOA information determined from the variation among the acquired signals.

23. The audio signal separation system of claim 1, wherein processing the one or more microphone signals using the direction of arrival (DOA) information and using the signal structure of the one or more sources comprises:

computing time-dependent spectral characteristics from the one or more microphone signals, the spectral characteristics comprising a plurality of components, each component associated with a respective pair of frequency (f) and time (n) values;

computing DOA estimates from at least two of the one or more microphone signals, each computed component of the spectral characteristics having a corresponding one of the direction estimates (d);

combining the computed spectral characteristics and the computed DOA estimates to form a data structure representing a distribution P(f,n,d) indexed by frequency (f), time (n), and direction (d);

forming an approximation Q(f,n,d) of the distribution P(f,n,d), the approximation having a hidden multiple-source structure assuming that the representative acquired signal was generated by a number of distinct acoustic sources indexed by s=1, . . . , S and each acoustic source of the one or more sources is associated with a subset of prototype frequency distributions indexed by z=1, . . . , Z so that the approximation can be factorized into constituent parts;

performing a plurality of iterations of adjusting components of a model of the approximation Q(f,n,d) to match the distribution P(f,n,d); and generating the one or more separated signals using the constituent parts of the approximation Q(f,n,d) corresponding to the one or more sources.

24. A non-transitory machine-readable storage medium storing instructions configured to, when executed, control a processor to perform signal separation according to source in an acoustic signal, the instructions comprising:

processing one or more microphone signals acquired by a plurality of microphone elements of a microphone unit and together representing a representative acquired signal and a variation among the signals acquired by the microphone elements to output one or more separated signals comprising signals separated according to corresponding one or more sources of said signals from the representative acquired signal, wherein the one or more microphone signals are processed using direction of arrival information determined from the variation among the acquired signals and using signal structure of the one or more sources by:

forming an approximation of the representative acquired signal, the approximation having a hidden multiple-source structure assuming that the representative acquired signal was generated by a number of distinct acoustic sources indexed by s=1, . . . , S and each acoustic source of the one or more sources is associated with a subset of prototype frequency distributions indexed by z=1, . . . , Z so that the approximation can be factorized into constituent parts, performing a plurality of iterations of adjusting components of a model of the approximation to match the representative acquired signal, and generating the one or more separated signals using the constituent parts of the approximation corresponding to the one or more sources.

25. The non-transitory machine-readable storage medium of claim 24, wherein the approximation includes the direction of arrival information determined from the variation among the acquired signals.

26. The non-transitory machine-readable storage medium of claim 24, wherein processing the one or more microphone signals using the direction of arrival information and using the signal structure of the one or more sources further comprises:

computing time-dependent spectral characteristics from the one or more microphone signals, the spectral characteristics comprising a plurality of components, each component associated with a respective pair of frequency (f) and time (n) values, computing DOA estimates from at least two of the one or more microphone signals, each computed component of the spectral characteristics having a corresponding one of the direction estimates (d), and combining the computed spectral characteristics and the computed DOA estimates to form a data structure representing a distribution P(f,n,d) indexed by frequency (f), time (n), and direction (d), wherein the approximation of the representative acquired signal comprises an approximation Q(f,n,d) of the distribution P(f,n,d).

27. The non-transitory machine-readable storage medium of claim 26, wherein the one or more separated signals are generated using a mask function M(f,n) computed for separating contributions of the one or more sources using the constituent parts of the approximation Q(f,n,d) corresponding to the one or more sources.

28. A method for performing signal separation according to source in an acoustic signal, the method comprising:

processing one or more microphone signals acquired by a plurality of microphone elements of a microphone unit and together representing a representative acquired signal and a variation among the signals acquired by the microphone elements to output one or more separated signals comprising signals separated according to corresponding one or more sources of said signals from the representative acquired signal, wherein the one or more microphone signals are processed using direction of arrival information determined from the variation among the acquired signals and using signal structure of the one or more sources by:

forming an approximation of the representative acquired signal, the approximation having a hidden multiple-source structure assuming that the representative acquired signal was generated by a number of distinct acoustic sources indexed by s=1, . . . , S and each acoustic source of the one or more sources is associated with a subset of prototype frequency distributions indexed by z=1, . . . , Z so that the approximation can be factorized into constituent parts, performing a plurality of iterations of adjusting components of a model of the approximation to match the representative acquired signal, and generating the one or more separated signals using the constituent parts of the approximation corresponding to the one or more sources.

29. The method of claim 28, wherein the approximation includes the direction of arrival information determined from the variation among the acquired signals.

30. An audio signal separation system for signal separation according to source in an acoustic signal, the system comprising:

a micro-electrical-mechanical system (MEMS) microphone unit comprising a plurality of acoustic ports provided at different spatial locations and configured to acquire acoustic signals comprising contributions from a plurality of acoustic sources; and a signal processing unit configured to process the acquired signals to separate contributions from a first acoustic source of the plurality of acoustic sources from contributions from other acoustic sources of the plurality of acoustic sources, wherein processing comprises processing the acquired signals using direction of arrival information determined from a variation among the signals acquired via different acoustic ports and using signal structure of one or more acoustic sources of the plurality of acoustic sources by:

forming an approximation of the representative acquired signal, the approximation having a hidden multiple-source structure assuming that the representative acquired signal was generated by a number of distinct acoustic sources indexed by s=1, . . . , S and each acoustic source of the one or more sources is associated with a subset of prototype frequency distributions indexed by z=1, . . . , Z so that the approximation can be factorized into constituent parts, performing a plurality of iterations of adjusting components of a model of the approximation to match the representative acquired signal, and generating the one or more separated signals using the constituent parts of the approximation corresponding to the one or more sources.

31. The audio signal separation system of claim 30, wherein the variation among the signals acquired via different acoustic ports represents at least one of a relative phase variation and a relative delay variation among the acquired signals for each of a plurality of spectral components.

32. The audio signal separation system of claim 30, wherein the spatial locations of the acoustic ports are coplanar locations.

33. The audio signal separation system of claim 32, wherein the coplanar locations comprise a regular grid of locations.

34. The audio signal separation system of claim 30, wherein the MEMS microphone unit comprises a package having multiple surface faces, and wherein the acoustic ports are on multiple of the faces of the package.

35. The audio signal separation system of claim 30, wherein the approximation includes the DOA information determined from the variation among the acquired signals.

36. The audio signal separation system of claim 30, wherein processing the one or more microphone signals using the direction of arrival information and using the signal structure of the one or more sources further comprises:

computing time-dependent spectral characteristics from the one or more microphone signals, the spectral characteristics comprising a plurality of components, each component associated with a respective pair of frequency (f) and time (n) values, computing DOA estimates from at least two of the one or more microphone signals, each computed component of the spectral characteristics having a corresponding one of the direction estimates (d), and combining the computed spectral characteristics and the computed DOA estimates to form a data structure representing a distribution P(f,n,d) indexed by frequency (f), time (n), and direction (d), wherein the approximation of the representative acquired signal comprises an approximation Q(f,n,d) of the distribution P(f,n,d).

37. A non-transitory machine-readable storage medium storing instructions configured to, when executed, control a processor to perform signal separation according to source in an acoustic signal, the instructions comprising:

processing signals representative of acoustic signals comprising contributions from a plurality of acoustic sources, the acoustic signals acquired by a plurality of acoustic ports of a micro-electrical-mechanical system (MEMS) microphone unit, to separate contributions from a first acoustic source of the plurality of acoustic sources from contributions from other acoustic sources of the plurality of acoustic sources, wherein the signals are processed using direction of arrival information determined from a variation among the signals acquired via different acoustic ports and using signal structure of one or more acoustic sources of the plurality of acoustic sources by:

forming an approximation of the acquired signals, the approximation having a hidden multiple-source structure assuming that the representative acquired signals were generated by a number of distinct acoustic sources indexed by s=1, . . . , S and each acoustic source of the one or more sources is associated with a subset of prototype frequency distributions indexed by z=1, . . . , Z so that the approximation can be factorized into constituent parts, performing a plurality of iterations of adjusting components of a model of the approximation to match the acquired signals, and separating the contributions from the first acoustic source using the constituent parts of the approximation corresponding to the first acoustic source.

38. A method for performing signal separation according to source in an acoustic signal, the method comprising:

processing signals representative of acoustic signals comprising contributions from a plurality of acoustic sources, the acoustic signals acquired by a plurality of acoustic ports of a micro-electrical-mechanical system (MEMS) microphone unit, to separate contributions from a first acoustic source of the plurality of acoustic sources from contributions from other acoustic sources of the plurality of acoustic sources, wherein the signals are processed using direction of arrival information determined from a variation among the signals acquired via different acoustic ports and using signal structure of one or more acoustic sources of the plurality of acoustic sources by:

forming an approximation of the acquired signals, the approximation having a hidden multiple-source structure assuming that the representative acquired signals were generated by a number of distinct acoustic sources indexed by s=1, . . . , S and each acoustic source of the one or more sources is associated with a subset of prototype frequency distributions indexed by z=1, . . . , Z so that the approximation can be factorized into constituent parts, performing a plurality of iterations of adjusting components of a model of the approximation to match the acquired signals, and separating the contributions from the first acoustic source using the constituent parts of the approximation corresponding to the first acoustic source.

* * * * *